United States Patent [19]

Lamb

[11] Patent Number: 4,727,683

[45] Date of Patent: Mar. 1, 1988

[54] ABRASIVE BELT MACHINE

[75] Inventor: Michael W. Lamb, Grand Island, N.Y.

[73] Assignee: Dynabrade, Inc., Tonawanda, N.Y.

[21] Appl. No.: 1,868

[22] Filed: Jan. 9, 1987

[51] Int. Cl.[4] ..... B24B 21/00

[52] U.S. Cl. ..... 51/147; 51/135 R

[58] Field of Search ..... 51/135 R, 147, 141, 51/170 EB, 142, 148

[56] References Cited

U.S. PATENT DOCUMENTS 1,199,672 9/1916 Dick ..... 51/266

1,798,421 3/1931 Hitchcock ..... 51/147

*Primary Examiner*—Frederick R. Schmidt

*Assistant Examiner*—Maurina Rachuba

*Attorney, Agent, or Firm*—Bean, Kauffman & Bean

[57] ABSTRACT

An abrasive belt machine is disclosed as including a stationary base for mounting parallel, belt drive and tension control rollers and a support arm having a free end portion projecting from the base; a contact arm for mounting an idler roller; mounting means for removably mounting the contact arm on the free end portion of the support arm for pivotal movement about a belt position adjustment axis disposed parallel to the axes of the belt drive and tension control rollers and the idler roller; and first, second and third tension rollers mounted for movement with the contact arm and serving to guide an abrasive belt for passage over the idler roller, during pivotal movement of the contact arm about the adjustment axis through upwards of essentially 180 degrees.

10 Claims, 9 Drawing Figures

Fig. 1.
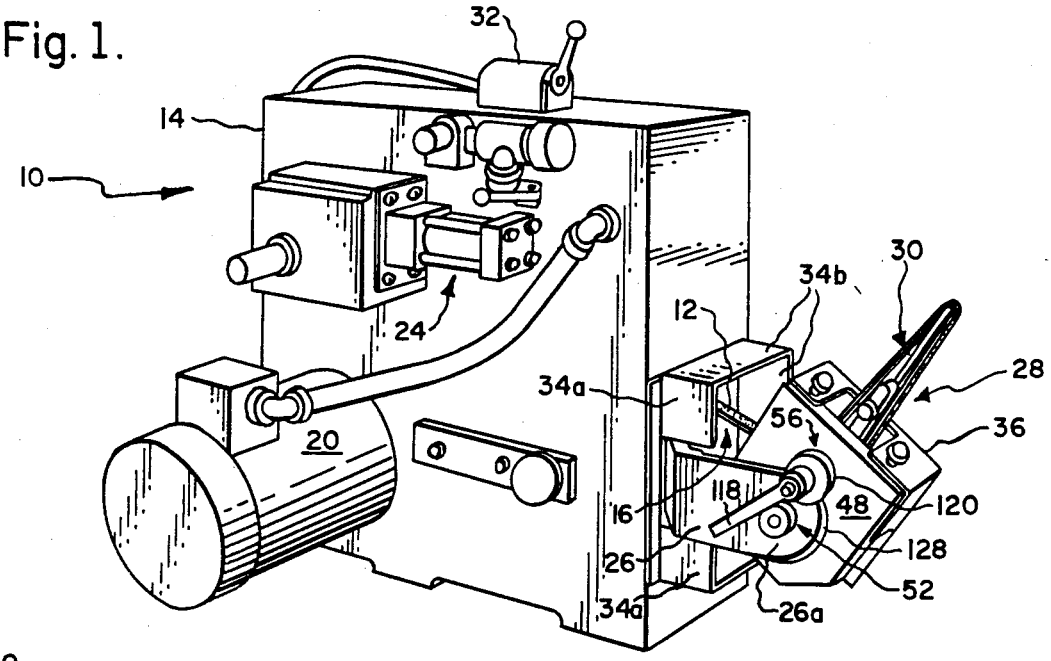
Fig. 2.
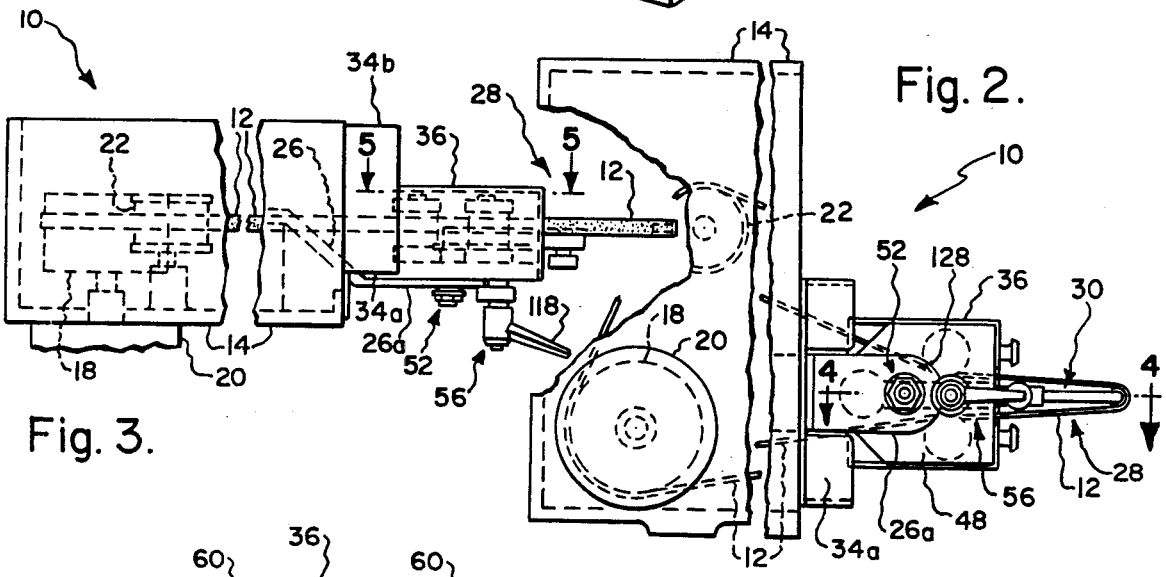
Fig. 3.
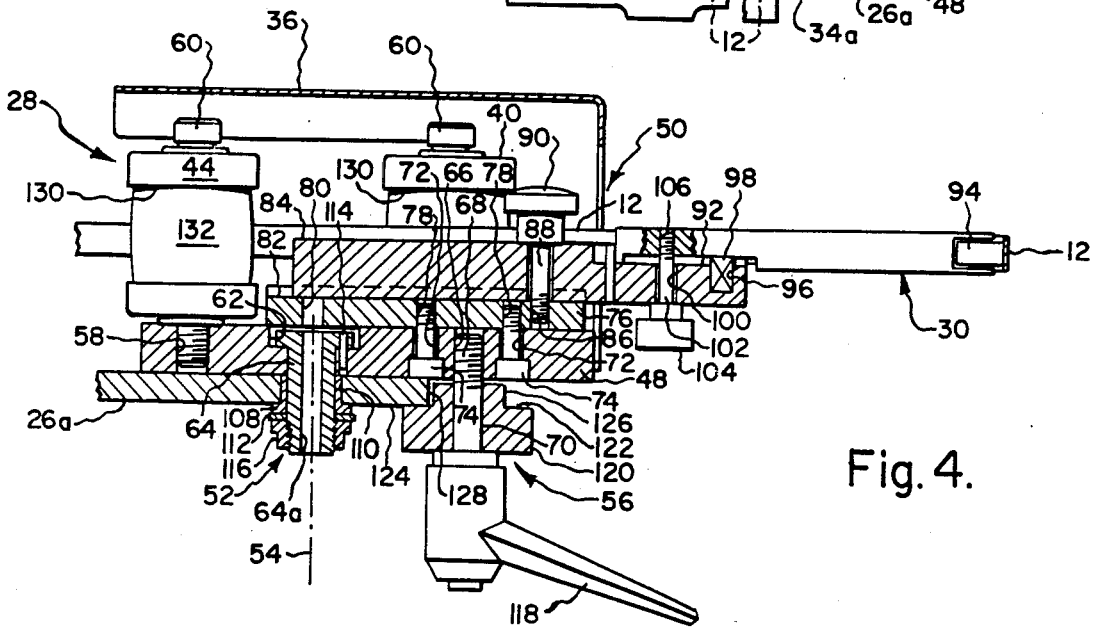
Fig. 4.

Fig. 5.
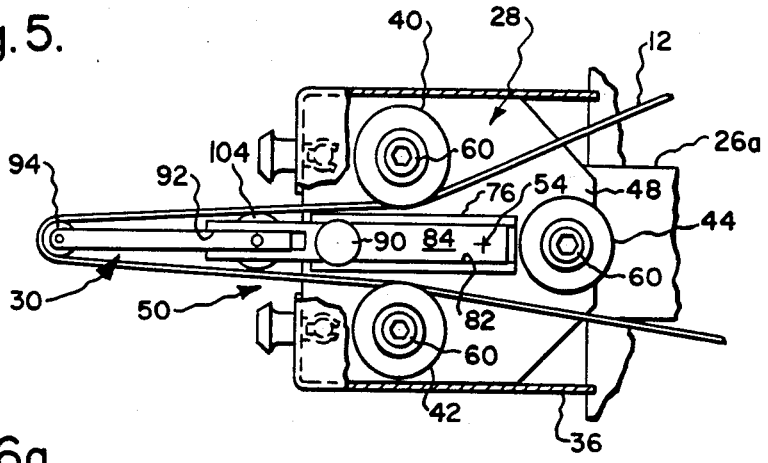
Fig. 6a.
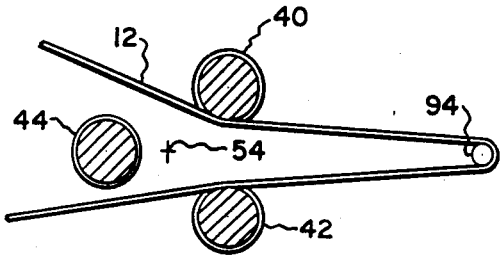
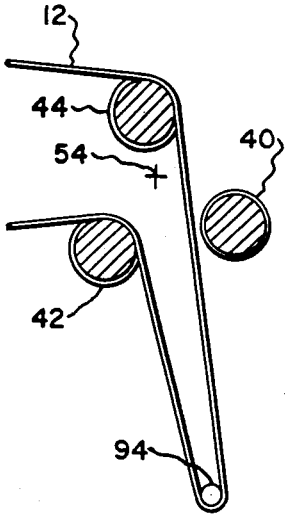
Fig. 6c.
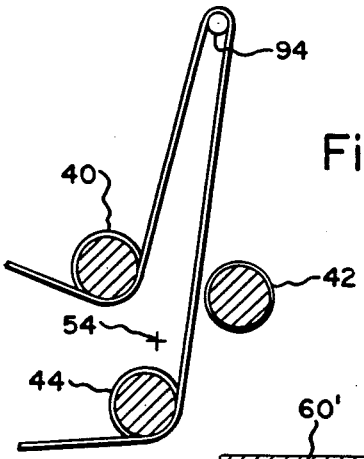
Fig. 6b.
Fig. 7.
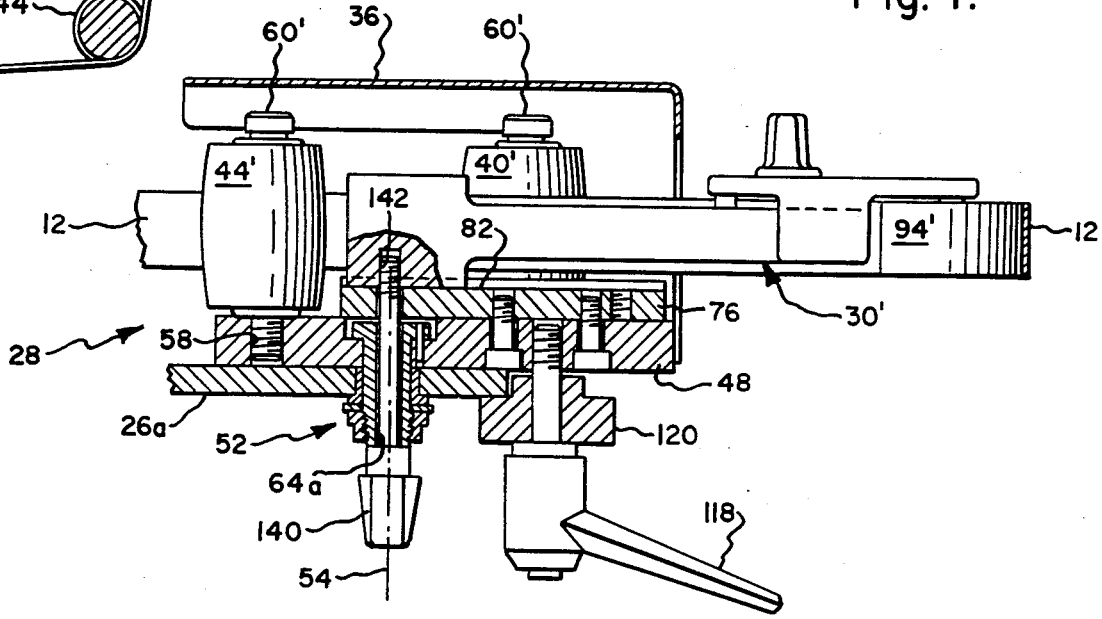

ABRASIVE BELT MACHINE

BACKGROUND OF THE INVENTION

The present invention relates to stationary bench or standard mounted abrasive belt machines of the type wherein an operator of the machine normally presents an article to be ground or finished to an abrasive belt driven by the machine.

Prior commercially available machines of which I am aware appear to be of two general types. In a first type of machine, a post is fixed to upstand from a workbench and removably attached to the casing of a portable hand-operated belt grinder, such as for example grinders of the type disclosed in commonly assigned U.S. Pat. Nos. 3,823,513 and 4,368,597. The post is made adjustable, so as to allow the whole of the belt grinder to be tilted vertically as required to position its contact arm, and thus that portion of the abrasive belt trained thereabout, in a desired position convenient for use by an operator of the machine. A drawback of this type of machine is that belt width is limited by the size of the drive and tension rollers permanently built into the portable machine.

In a second type of machine, a stationary base or housing supported on a bench top or pedestal serves to mount belt drive and tension control rollers and means to removably support a contact arm of the type shown for instance in U.S. Pat. No. 3,823,513, whereby to permit an abrasive belt to be trained about the drive and tension control rollers and an idler or contact roller carried by the contact arm. While this type of machine is adapted to accommodate a wide range of belt widths by the expedient of changing the size of the contact arms fitted thereto, such machine has the drawback that each contact arm, and thus that portion of the belt trained thereover, is required to be maintained in a fixed position and not adapted to be adjusted for the convenience of an operator.

SUMMARY OF THE INVENTION

The present invention is directed towards an abrasive belt machine having a stationary base serving to permanently mount belt drive and tension control rollers and removably mount contact arms, which may be pivoted vertically relative to the base, as required to position an abrasive belt for convenience of an operator of the machine.

More specifically, the present invention is directed towards an abrasive belt machine comprising a stationary base mounting belt drive and tension control rollers and a support arm extending from the base in a direction essentially normal to the axes of such rollers; a contact arm having an idler roller adjacent one end thereof; mounting means for mounting an opposite end of the contact arm on the support arm for pivotal movement about a belt position adjustment axis incident to which an axis of rotation of the idler roller is disposed essentially parallel to the axes of the drive and tension control rollers and the adjustment axis and moves along an arcuate path of travel disposed concentrically of the adjustment axis; and first, second and third tension rollers having their axes disposed essentially parallel to the adjustment axis and mounted on the mounting means for pivotal movement with the contact arm, wherein the first and second tension rollers straddle the contact arm adjacent its opposite end and are arranged essentially equidistant from the idler roller, the third tension roller is disposed equidistant from the first and second tension rollers, and the third tension and idler rollers are disposed on opposite sides of a plane passing through the axes of the first and second tension rollers. An endless belt is adapted to be trained in succession about the drive roller, the tension control roller, intermediate the first and third tension rollers, about the idler roller and intermediate the second and third tension rollers for return to the drive roller. The first, second and third tension rollers are arranged such that the first and second tension rollers engage with the abrasive belt adjacent a mid portion of the path of travel of the idler roller, at least the first and third tension rollers engage with the belt adjacent one end portion of such path of travel, at least the second and third tension rollers engage with the abrasive belt adjacent an opposite end of such path of travel, and the third tension roller is disengaged from the belt adjacent the mid portion of such path of travel.

BRIEF DESCRIPTION OF THE DRAWINGS

The nature and mode of operation of the present invention will now be more fully described in the following detailed description taken with the accompanying drawings wherein:

FIG. 1 is a perspective view of an abrasive belt machine incorporating the present invention;

FIG. 2 is a fragmentary side elevational view thereof;

FIG. 3 is a fragmentary top plan view thereof;

FIG. 4 is an enlarged sectional view taken generally along the line 4—4 in FIG. 2;

FIG. 5 is an enlarged sectional view taken generally along the line 5—5 in FIG. 3;

FIGS. *6a*, *6b* and *6c* are diagrammatic views illustrating alternative belt positions; and FIG. 7 is a view similar to Fig, 4, but showing an alternative contact arm installation.

DETAILED DESCRIPTION

Reference is first made to FIGS. 1–3, wherein a machine incorporating the present invention is generally designated as 10 and shown as being adapted for use in driving an endless, flexible abrasive belt 12 suitable for performing a desired surface finishing operation, such as grinding, buffing or polishing, on a workpiece, not shown, adapted to be presented to the belt by the hands of an operator of the machine, also not shown.

Machine 10 generally comprises a base defined for instance by a housing 14 having an opening 16 facing towards the front of the housing and an operator of the machine; a crowned surface, belt drive roller 18, which is located within the housing and driven for example by an externally mounted electric motor 20; a belt tension control roller 22, which is supported within the housing for movement between belt release and variable, tightening positions and operably coupled to a suitable externally mounted, belt tension control device, such as a pneumatically operated control cylinder 24; a support 26 fixed within the housing and having a free end portion *26a* arranged to extend outwardly through opening 16; and a mounting assembly 28 for use in removably mounting a contact arm 30 on support arm free end portion *26a*. Housing 14 may be supported at a height convenient for an operator of machine 10, as by means of a bench or pedestal, not shown.

Machine 10 may be fitted with a switch device 32 to control motor 20 for purposes of changing the direction in which belt 12 is driven and safety shield devices 34*a*, 34*b* and 36 may be associated with housing 14 and assembly 28 for purposes of limiting the extent of belt 12, which is exposed for use during operation of the machine. In the illustrated construction, shield device 34*a* is fixed to housing 14 and shield device 34*b* is fixed to a hinged door panel, not shown, forming a wall surface of housing 14 opposite to that on which motor 20 and cylinder 24 are mounted. Shield device 34*b* and its associated door panel may be opened and shield device 36 may be removed from mounting assembly 28 for purposes of affording access to belt 12 for removal/mounting purposes.

It will be understood that abrasive belt machines having the overall combination of elements thus far generally described are well known and, thus, it is deemed necessary to illustrate and describe in detail only the structure of mounting assembly 28 and means in the form of first, second and third tension rollers 40, 42 and 44 carried thereby to assure proper tracking of belt 12 relative to contact arm 30, which principally distinguishes the present machine from those known in the art.

Now making particular reference to FIGS. 4 and 5, it will be understood that mounting assembly 28 generally includes a pivot plate 48; attachment means 50 for releasably attaching contact arm 30 to the pivot plate; pivot means 52 for mounting the pivot plate on free end portion 26*a* for pivotal movement about an adjustment axis 54, which is disposed parallel to the rotational axes of belt drive and tension rollers 18 and 22; and clamping means 56 for releasably fixing the pivot plate in a desired pivotal position relative to the support arm 26. By referring to FIG. 4, it will be understood that pivot plate 48 is formed with threaded openings 58 adapted to receive screw threaded ends of bearing devices 60 for purposes of mounting tension rollers 40, 42 and 44 on the pivot plate with their axes parallel to the adjustment axes; a stepped bore opening 62 for receiving a stepped diameter pivot shaft 64 forming a part of pivot means 52; a threaded opening 66 for receiving a threaded end portion 68 of a shank 70 forming a part of clamping means 56; and stepped bore openings 72 for receiving threaded bolts 74 adapted to securely clamp attachment means 50 to the pivot plate.

Attachment means 50 is shown in FIGS. 4 and 5 as including an adapter plate 76 having threaded openings 78 arranged to receive bolts 74; a through bore opening 80 disposed in axial alignment with a through bore opening 64*a* of pivot shaft 64; a lengthwise extending guide slot 82 sized to slidably/removably receive a contact arm adapter 84; and a screw threaded opening 86 adapted to receive the threaded shank 88 of a clamping knob 90 serving to releasably clamp adapter 84 against adapter plate 76 within slot 82.

Adapter 84 is formed at one end with a slot 92 sized to pivotally/removably receive an end of contact arm 30 disposed opposite to the end thereof serving to journal an idler or contact roller 94; a blind bore opening 96 sized to receive a contact arm biasing spring 98; and a through bore opening 100 adapted to removably receive the threaded shank 102 of a clamping knob 104, which is adapted to be threadably received within a threaded mounting opening 106 extending through contact arm 30. The structure of contact arm 30 and the illustrated arrangement for pivotally/removably attaching same within slot 92 of a suitable adapter is shown and described in U.S. Pat. No. 3,823,513 whose disclosure is incorporated herein by reference.

Pivot means 52 includes in addition to pivot shaft 64, a bushing 108 serving to journal the pivot shaft within a through bore opening 110 formed in support arm free end portion 26*a;* a washer 112; a retaining pin 114 serving to prevent rotational movement of the pivot shaft relative to pivot plate 48; and a lock nut 116 serving to maintain the pivot shaft assembled relative to the pivot plate and the support arm.

Clamping means 56 includes a clamping knob or handle 118 fixed for rotation with shank 70 remotely of threaded end portion 68, and a clamping member 120 supported on shank 70. Clamping member 120 is provided with a clamping surface 122 spaced from pivot plate 48 and arranged to clamp against a surface 124 of support arm 26, which faces away from the pivot plate, upon rotation of clamping knob 118 in a clockwise direction, as viewed in FIG. 2. Preferably, clamping member 120 is of stepped diameter construction so as to define a second, cylindrical surface 126 arranged to freely, slidably engage with an arcuate end surface 128 of support arm 26, which is disposed concentrically of adjustment axis 54.

Tension rollers 40, 42 and 44 are preferably like sized and positioned relative to one another, adjustment axis 54 and idler roller 94 such that abrasive belt 12 is maintained in a relatively close straddling relationship to contact arm 30 throughout the extent of travel of the idler roller about the adjustment axis.

It will be understood that the type of contact arm and tension rollers to be mounted on assembly 28 will be determined by the width of the belt 12 desired to be used in performing a given surface finishing operation. Thus, for example, when a relatively narrow belt of on the order of between $\frac{1}{4}$ and $\frac{3}{4}$ inch in width is to be employed, it is preferably to employ the contact arm designated as 30 in FIGS. 1–5, which is of the type commercially available from Dynabrade, Inc. of Tonawanda, New York for use on their DYNAFILE II portable belt grinder, and tension rollers 40, 42 and 44 having circumferentially extending belt guiding grooves 130 formed with a crowned guide surface 132 and an axial length only sufficient to permit a $\frac{3}{4}$ inch belt to be freely inserted within such groove. For belt widths greater than about $\frac{3}{4}$ inch, the contact arm will preferably be of the type designated as 30' in FIG. 7 and available commercially from Dynabrade, Inc. for use on their DYNABELTER portable belt grinder, and tension rollers, which are designated as 40', 42' and 44', would have crowned surfaces extending between the ends thereof. Contact arm 30' may be mounted in place of contact arm 30 by first rotating clamping knob 90 to permit removal of adapter 84; inserting an end of arm 30', which is opposite to that carrying idler roller 94', within adapter slot 82; and then securing contact arm 30' in place by inserting a clamp knob 140 through pivot shaft bore opening 64*a* for receipt within a threaded opening 142 provided in such contact arm. Tension rollers 40', 42' and 44' may be mounted in place of tension rollers 40, 42 and 44 by simply unthreading bearing devices 60 from within threaded openings 58 and then inserting bearing devices 60' as shown in FIG. 4. For all cases, the axial length of the idler roller of the chosen contact arm will essentially correspond to the width of the belt to be employed.

In all forms of the invention, the rotational axis of the idler roller carried by the contact arm will be disposed essentially parallel to the rotational axes of the tension rollers and the adjustment axis and be adapted to be swung manually, upon release of clamp device 56, through a path of travel disposed concentrically of the adjustment axis. Further, the tension rollers will be arranged such that the first and second tension rollers straddle an end of the contact arm disposed remotely of its idler roller; and the third tension and idler rollers will be disposed on opposite sides of a plane passing through the axes of the first and second tension rollers. Preferably, the adjustment axis lies essentially within a plane defined by the rotational axes of the idler and third tension rollers and is disposed intermediate the third tension roller and the above referred to plane passing through the axes of the first and second tension rollers. It is also preferable to arrange the first and second tension rollers essentially equidistant from the idler roller and from the third tension roller as best shown in FIG. 5 and FIGS. 6*a*–6*c*.

In the illustrated construction, the idler roller may be moved through a path of travel slightly exceeding 180 degrees. This path of travel is considered to have a mid portion centrally of which the abrasive belt engages with the first and second tension rollers, but is preferably free of contact with the third tension roller as shown generally in FIG. 6*a;* one end portion, wherein at least the first and third tension rollers engage with the belt, as shown in FIG. 6*b;* and a second or opposite end portion, wherein at least the second and third tension rollers engage with the belt, as shown in FIG. 6*c*.

It has been found that relatively narrow abrasive belts having widths of less than about ¾ inch present a unique problem with regard to maintaining same in tracking engagement with idler roller 94 throughout its permitted range of travel relative to adjustment axis 54. In this respect, it has been found that proper belt tracking conditions normally exist at and within a few degrees on opposite sides of the centralmost portion of the path of travel shown in FIG. 6*a* and adjacent each opposite end portion of such path of travel, but that it is impossible to prevent relatively narrow belts from riding axially off the idler roller between these adjusted positions thereof without providing tension rollers 40, 42 and 44 with guide grooves 130. This belt tracking phenomena does not appear to occur for relatively wide abrasive belts in that same are dimensionally more stable than typical belts having widths of between ¼ and ¾ inch, and accordingly, grooved tension rollers need not normally be employed for relatively wide abrasive belts.

In operation of machine 10, abrasive belt 12 is first mounted by being trained in succession about drive roller 18; tension control roller 20, while same is in a belt release position, not shown; intermediate first and third tension rollers 40 and 44 (or 40' and 44') about idler roller 94 (or 94'); and intermediate second and third tension rollers 42 and 44 (or 42' and 44') for return to the drive roller. Thereafter, control cylinder 24 is operated to apply a bias to tension control roller 22 for purposes of applying a desired degree of tension to the belt. Idler roller 94 (or 94') may be releasably fixed at any desired position along its path of travel by operation of knob 118 before or after operation of control cylinder 24, but care should be exercised to insure that assembly 28 is securely clamped in position whenever belt 12 is being driven by motor 20. As a practical matter, the maximum width of the abrasive belt which can be mounted on machine 10 is limited only by the width of opening 16 and the axial lengths of the rollers employed.

What is claimed is:

1. A machine for supporting and driving an endless abrasive belt comprising in combination:

a base mounting a powered belt drive roller, a belt tension control roller and a support arm, said drive and tension control rollers having essentially parallel axes of rotation, said support arm having a free end portion projecting from said base in a direction generally towards a user of said machine and normal to said axes;

a contact arm mounting an idler roller adjacent one end thereof;

mounting means for mounting an opposite end of said contact arm on said free end portion for pivotal movement about a belt position adjustment axis incident to which an axis of rotation of said idler roller is disposed essentially parallel to said axes of said drive and tension control rollers and said adjustment axis and moves along an arcuate path of travel disposed concentrically of said adjustment axis, said path of travel being disposed outwardly of said free end portion in a direction away from said base, said mounting means includes means for releasably fixing the pivotal position of said contact arm relative to said free end portion about said adjustment axis; and first, second and third tension rollers having their axes disposed essentially parallel to said adjustment axis and mounted on said mounting means for pivotal movement with said contact arm, said first and second tension rollers straddling said contact arm adjacent said opposite end thereof, said third tension roller and said idler roller are disposed on opposite sides of a plane passing through said axes of said first and second tension rollers, said endless belt is adapted to be trained in succession about said drive roller, said tension control roller, intermediate said first and third tension rollers, about said idler roller, and intermediate said second and third tension rollers for return to said drive roller, said first, second and third tension rollers being arranged such that said first and second tension rollers engage with said belt adjacent a mid portion of said path of travel, at least said first and third tension rollers engage with said belt adjacent one end portion of said path of travel, and at least said second and third tension rollers engage with said belt adjacent an opposite end of said path of travel.

2. A machine according to claim 1, wherein said mounting means includes a pivot plate for supporting said first, second and third tension rollers, means for releasably attaching said opposite end of said contact arm to said plate, and pivot means mounting said plate on said free end portion for pivotal movement about said adjustment axis.

3. A machine according to claim 2, wherein said means for releasably fixing the pivotal position of said contact arm includes clamp means for releasably clamping said free end portion and said plate against relative movement about said adjustment axis.

4. A machine according to claim 3, wherein said clamp means includes a clamp handle having a shank formed with a threaded free end portion received within a threaded opening formed in said plate and a clamping member carried on said shank intermediate said handle and said threaded free end portion, and said clamp member has a clamping surface spaced from said plate for clamping engagement with a surface of said free end portion facing away from said plate.

5. A machine according to claim 4, wherein said free end portion has an arcuate end surface disposed concentrically of said adjustment axis and said clamp member includes a second surface freely, slidably engaging with said arcuate end surface.

6. A machine according to claim 3, wherein said first, second and third tension rollers are provided with circumferentially extending grooves for receiving said abrasive belt therewithin.

7. A machine according to claim 2, wherein said means for releasably attaching said opposite end of said contact arm includes a slot for receiving said opposite end of said contact arm and means extending axially through said pivot means for releasably clamping said opposite end of said contact arm within said slot.

8. A machine according to claim 1, wherein said first, second and third tension rollers are provided with circumferentially extending grooves for receiving said abrasive belt therewithin.

9. A machine according to claim 8, wherein said second and first tension rollers are disengaged from said belt adjacent said one end portion and said opposite end portion of said path of travel, respectively, and said third tension roller is disengaged from said belt adjacent said mid portion of said path of travel.

10. A machine according to claim 1, wherein said path of travel extends through essentially 180 degrees.

* * * * *